US012220067B2

(12) United States Patent
Kaiser et al.

(10) Patent No.: US 12,220,067 B2
(45) Date of Patent: Feb. 11, 2025

(54) CONVERTIBLE PLAY PEN

(71) Applicant: Kidco, Inc., Vernon Hills, IL (US)

(72) Inventors: Daniel Kaiser, Cape Coral, FL (US); Kenneth Kaiser, Cape Coral, FL (US)

(73) Assignee: KIDCO, INC., Vernon Hills, IL (US)

( * ) Notice: Subject to any disclaimer, the term of this patent is extended or adjusted under 35 U.S.C. 154(b) by 502 days.

(21) Appl. No.: 17/717,865

(22) Filed: Apr. 11, 2022

(65) Prior Publication Data

US 2023/0320499 A1 Oct. 12, 2023

(51) Int. Cl.
*A47D 13/06* (2006.01)

(52) U.S. Cl.
CPC ..... *A47D 13/063* (2013.01)

(58) Field of Classification Search
CPC ... A47D 13/061; A47D 13/063; A47D 13/065
See application file for complete search history.

(56) References Cited

U.S. PATENT DOCUMENTS 4,937,962 A * 7/1990 Hornblad ..... G09F 17/00 40/604
D351,756 S * 10/1994 Miller ..... D6/333
5,813,064 A * 9/1998 Hartenstine ..... A47D 13/06 5/99.1
6,026,528 A * 2/2000 Pina ..... A47D 15/00 5/503.1
6,123,091 A * 9/2000 Flynn ..... A47D 13/063 135/132
D442,811 S * 5/2001 Delaplaine ..... D6/596
6,390,260 B1 * 5/2002 Roegner ..... A47D 13/063 5/655
6,467,107 B1 * 10/2002 Glover ..... A47C 7/66 5/99.1
6,687,927 B1 * 2/2004 Tharalson ..... A47D 15/00 5/98.1

(Continued)

FOREIGN PATENT DOCUMENTS

CN 105706942 A * 6/2016
CN 210520599 U * 5/2020
CN 213573308 U * 6/2021

OTHER PUBLICATIONS

"The Pop 'N Go Playpen: Easy Set Up & Take Down." Accessed online Oct. 16, 2024 at youtube.com. Published Jul. 17, 2019. Retrieved from URL: https://www.youtube.com/watch?v=IEdtgN-9mYo (Year: 2019).*

*Primary Examiner* — Eric J Kurilla
(74) *Attorney, Agent, or Firm* — Quarles & Brady, LLP

(57) ABSTRACT

A play pen has a frame and a fabric substrate defining an enclosure and has a main body. The frame has a plurality of legs and a central post. The main body has an entrance, a plurality of storage pockets, and a display pocket. The entrance has a first fastener. The plurality of storage pockets defines a first pocket formed between the main body and a storage sheet. The storage sheet is sewn to the main body on a first edge and secured to the main body on a second edge by a second fastener. The display pocket defines a second pocket formed between the main body and a transparent or translucent cover sheet. The cover sheet is sewn to the main body on a third edge and secured to the main body on a fourth edge by a third fastener, and faces the enclosure.

7 Claims, 17 Drawing Sheets

(56) References Cited

U.S. PATENT DOCUMENTS 6,799,337 B1 * 10/2004 Raphael-Davis ..... A47D 7/00 5/663
7,185,666 B2 * 3/2007 Chai ..... E04H 15/48 135/156
9,320,363 B1 * 4/2016 Beaver ..... G01K 13/00
D862,913 S * 10/2019 Jin ..... D6/331
D864,333 S * 10/2019 Wu ..... D21/834
10,557,282 B1 * 2/2020 Flannery ..... E04H 15/02
D880,172 S * 4/2020 Wright ..... D6/331
11,391,056 B1 * 7/2022 Flannery ..... A47C 29/003
D961,712 S * 8/2022 Qiu ..... D21/834
D997,282 S * 8/2023 Wright ..... D21/834
D1,020,961 S * 4/2024 Pagano ..... D21/837
2003/0098053 A1 * 5/2003 Huang ..... A47C 29/003 135/96
2004/0099301 A1 * 5/2004 Zhang ..... E04H 15/28 5/97
2005/0034232 A1 * 2/2005 Martin ..... A47D 7/02 5/93.1
2006/0231129 A1 * 10/2006 Ferraro, Sr. ..... E04H 15/28 135/156
2006/0289048 A1 * 12/2006 Choi ..... E04H 15/48 135/156
2007/0215192 A1 * 9/2007 Hoffman ..... E04H 15/38 52/75
2008/0047597 A1 * 2/2008 Rothweil ..... E04H 15/48 135/126
2010/0122413 A1 * 5/2010 McNair ..... A47C 31/00 5/503.1
2014/0261603 A1 * 9/2014 Leblanc ..... E04H 15/28 135/147
2016/0143453 A1 * 5/2016 Shapiro ..... A47D 13/063 256/25
2020/0232247 A1 * 7/2020 Jin ..... E04H 15/48

* cited by examiner

CONVERTIBLE PLAY PEN

BACKGROUND

Field of the Disclosure

The present disclosure relates to a play pen that converts between a collapsed, storage, or pre-assembled configuration, and an extended, final, or assembled configuration.

Description of the Background of the Disclosure

Play pens are used to allow infants, babies, and young children to play within a confined area. The play pen serves as a way to make the supervision of a child easier for adults by limiting the area to which the child can travel. Typical play pens are often fixed structures that are difficult to transport or to store, which leads to many play pens being left out, unused, in between uses, so that they take up unnecessary space and/or create eyesores in the area where they are located.

Relatedly, typical play pens may tout themselves as being portable, so that parents can pack them up and transport them to a secondary location for use when not at home. In reality, many portable play pens are bulky or not easily collapsible, making it more awkward and, therefore, less desirable to use them.

In order to address one or more of these issues, play pens have been designed using more flexible materials and/or configurations that are designed to make them more lightweight or more transportable. One side effect of this, however, is that such play pens may become harder to fold, as portions of the play pens may collapse on themselves or snag or bind on other parts of the play pen.

In addition to their foldability issues, typical play pens are not designed to provide any form of entertainment.

Therefore, it would be desirable to have a play pen that addresses one or more of these shortcomings or one or more other shortcomings related to those already discussed.

SUMMARY

In some aspects, a play pen comprises a frame and a fabric substrate. The frame has a plurality of legs pivotally connected to a central post having a first axis. The fabric substrate has a main body. The main body comprises an entrance, a plurality of pockets, and a display pocket. The entrance has a first seam with an at least one first fastener. The plurality of storage pockets define an at least one first pocket formed between the main body and a storage sheet which is sewn to the main body on at least one first edge and is secured to the main body on at least one second edge by an at least one second fastener. The display pocket defines a second pocket formed between the main body and a transparent or translucent cover sheet which is sewn to the main body on at least one third edge and is secured to the main body on at least one fourth edge by an at least one third fastener. The fabric substrate defines an enclosure and the cover sheet faces the enclosure.

In some aspects, the entrance is configured to be opened or closed along the at least one first fastener. In some aspects, the plurality of storage pockets is configured to be opened or closed along the at least one second fastener. In some aspects, the display pocket is configured to be opened or closed along the at least one third fattener. In some aspects, at least one of the at least one first pockets is configured to receive a first tablet. In some aspects, the second pocket is configured to receive the first tablet. In some aspects, the cover sheet is configured to face toward the first axis.

In some aspects, a play pen comprises a frame, a fabric substrate, a canopy, and a plurality of first straps. The frame has a plurality of legs, a central post with a first axis and having a first fastener, a collar that can selectively slide along the central post, and a plurality of push rods. The fabric substrate has a main body and a first edge. The canopy is configured to be flexible and pliable. The canopy has a second edge along the periphery, a central point, and a middle region between the central point and the second edge. The plurality of first straps have a clip at a first end that is secured to one of the plurality of push rods, and the first end is opposite a second end which is secured to the middle region. The central point intersects the first axis, and the central point is secured to the first fastener. The first edge and the second edge are secured together along a seam. A first horizontal plane intersects the first fastener. In an assembled or first configuration, the collar is in a first position, and the second edge, the middle region, and the central point intersect the first horizontal plane. In a pre-assembled or second configuration, the collar is in a second position, and the middle region is positioned above the first horizontal plane and the second edge is positioned below the first horizontal plane.

In some aspects, each of the plurality of push rods has a third end opposite a fourth end, and the third end is closer to the first axis than the fourth end. In some aspects, the third end moves away from the central point as the play pen is moving from the assembled configuration to the pre-assembled configuration. In some aspects, the fourth end moves toward the first axis as the play pen is moving from the assembled configuration to the pre-assembled configuration. In some aspects, the clip of the plurality of first straps is configured to be secured or unsecured to each of the plurality of push rods. In some aspects, each of the fourth ends is connected to each of the plurality of legs by a push sleeve. In some aspects, each of the push sleeves is configured to be retained on and slide along a first length of one of the plurality of legs.

In some aspects, a play pen comprises a frame and a fabric substrate. The frame has a plurality of legs pivotally connected to a central post having a first axis. The fabric substrate has a main body which comprises a plurality of sleeves, and a plurality of storage pockets. The plurality of sleeves connect the main body to the frame. The plurality of storage pockets defines a first pocket, a second pocket, and a third pocket formed between the main body and a storage sheet which is sewn to the main body. The storage sheet has a first sewn seam between the first pocket and the second pocket, a second sewn seam between the second pocket and the third pocket, and at least one third sewn seam that secures the storage sheet to the main body. The first pocket having an at least one first fastener, the second pocket having an at least one second fastener, and the third pocket having an at least one third fastener. The fabric substrate defines an enclosure and the plurality of storage pockets face the enclosure. The at least one first fastener is positioned on the main body and on the storage sheet.

In some aspects, the at least one first fastener includes hooks on the first storage sheet. In some aspects, the at least one first fastener includes loops on the main body. In some aspects, the at least one first fastener includes a zipper. In some aspects, a plurality of second storage pockets that define at least one fourth pocket that is formed between the main body and a second storage sheet. The second storage sheet is sewn to the main body, and has a fourth sewn seam that connects the second storage sheet to the main body. The at least one fourth pocket has an at least one fourth fastener. In some aspects, the plurality of first storage pockets are positioned between a first pair of the plurality of legs, and the plurality of second storage pockets are positioned between a second pair of the plurality of legs. The first pair and the second pair are different.

DETAILED DESCRIPTION

The following discussion and accompanying figures disclose various aspects or configurations of a collapsible play pen that include the play pen configured in a final or extended configuration, and in a collapsed or storage configuration. The play pen has an enclosure that can be adapted to provide, within the enclosure, varying levels of light, ventilation, and protection from the wind, as desired. The play pen may provide protection from the sun and/or rain within the enclosure by having a canopy and a set of roof or rafter panels. The play pen may provide some storage capacity on the sheets of the panels that are defined by a frame. The play pen may provide a display pocket that is suitable for retaining a tablet, such as an iPad® for instance, and has a translucent sheet or pocket that allows a screen of the tablet to be easily viewable within the enclosure. The play pen may provide a degree of protection from flying insects, crawling insects, and other pests. The play pen has the capacity to collapse into a substantially smaller volume for easier storage and transport, or be expanded into a final or assembled configuration with a fully expanded enclosure in a quick and reliable manner.

Although aspects of a collapsible play pen are disclosed that are specific to play pens, concepts associated with aspects of the device may be implemented with a wide variety of tents, temporary storage facilities, temporary mobile medical facilities, and temporary or mobile living facilities, and other temporary or mobile structures. Accordingly, concepts described herein may be utilized in a variety of products and in a variety of applications.

The term "about," as used herein, refers to variations in the numerical quantity that may occur, for example, through typical measuring and manufacturing procedures used for knock down gate assembly manufacturing, or other articles of manufacture that may include aspects of the disclosure herein, through inadvertent error in these procedures, through differences in the manufacture, source, or purity of the ingredients used to make the compositions or mixtures or carry out the methods, and the like. Throughout the disclosure, the terms "about" and "approximately" refer to a range of values ±5% of the numeric value that the term precedes.

Figure 1:
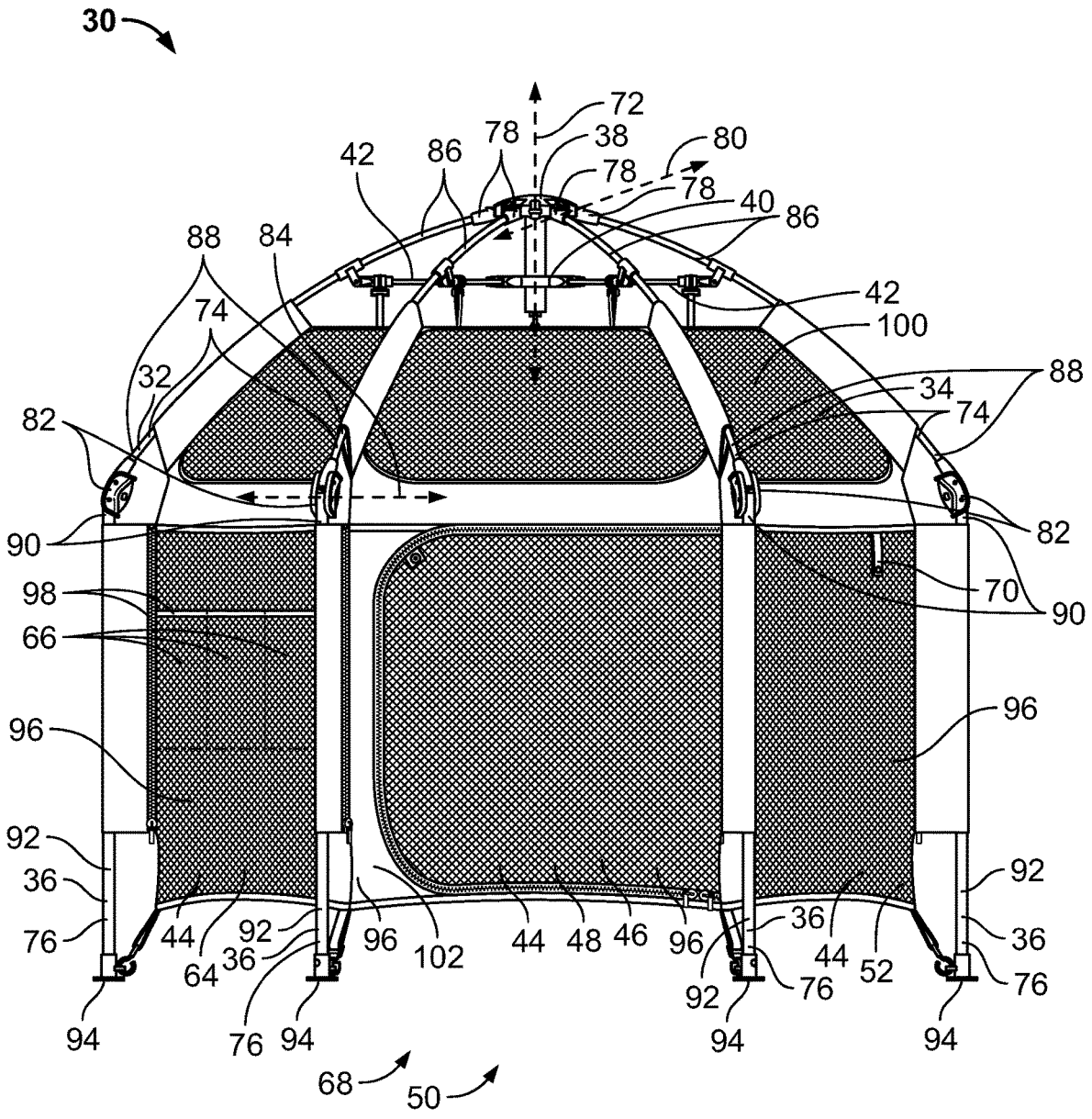
FIG. 1 is a first side view of a play pen, in accordance with the present disclosure.
Figure 2:
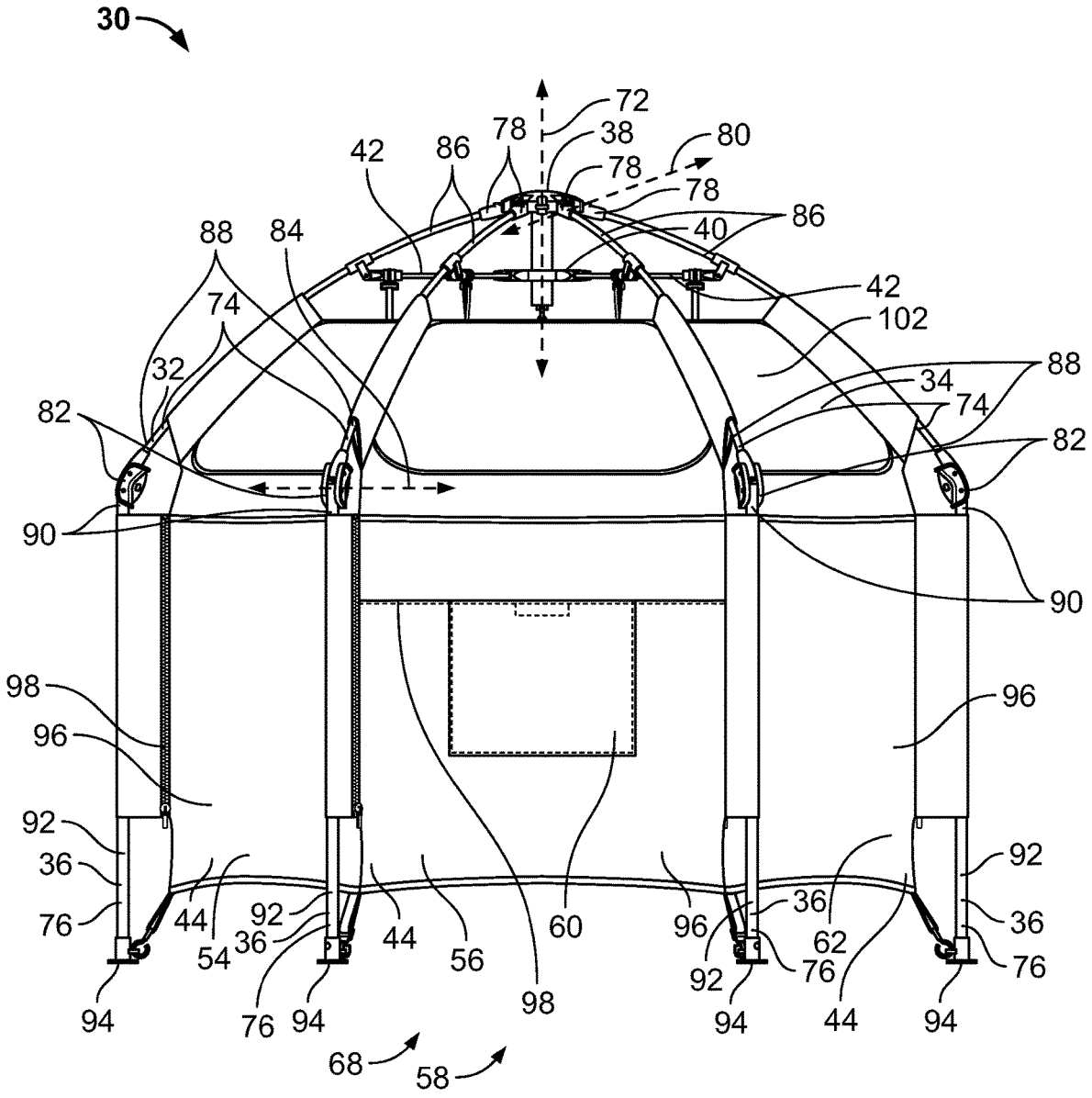
FIG. 2 is a second side view of the play pen of FIG. 1.

Referring to FIGS. 1 and 2, a play yard or play pen 30 is shown, which has a frame 32 which supports a fabric substrate 34. The frame 32 has a leg or a plurality of legs 36, a central post 38, a collar 40, and a push rod or a plurality of push rods 42. The fabric substrate 34 includes a portion or a plurality of portions 44, each portion 44 located between two adjacent legs 36. Referring to FIG. 1, an entrance 46 is located on a first portion 48 of the plurality of portions 44 and defines a front 50 of the play pen 30. A second portion 52 is located adjacent to the first portion 48 and to the right of the first portion 48 when viewed from outside the play pen 30 facing the entrance 46. Referring to FIG. 2, a third portion 54 is adjacent to and to the right of the second portion 52 (see FIG. 1). A fourth portion 56 is adjacent to and to the right of the third portion 54. The fourth portion 56 is defined as a rear 58 of the play pen 30. The fourth portion 56 includes a display pocket 60. A fifth portion 62 is adjacent to and to the right of the fourth portion 56. Referring to FIG. 1, a sixth portion 64 is adjacent to and to the right of the fifth portion 62 (see FIG. 2), and to the left of the first portion 48. The sixth portion 64 includes a storage pocket or a plurality of storage pockets 66. An enclosure 68 is defined as the interior volume of the fabric substrate 34. In some aspects, at least one portion 44 includes an auxiliary strap 70 (see FIG. 1, the second portion 52). In some aspects, the play pen 30 has six legs 36, six push rods 42, and six portions 44. In some aspects, the play pen 30 has more or less than six legs 36 and corresponding portions 44.

The central post 38 has a first axis 72, and the collar 40 is positioned concentric to the central post 38 and the first axis 72. Each leg 36 has a roof rod 74 and a pole 76. An upper or first hinge 78 pivotably connects the central post 38 to a respective roof rod 74 along a second axis 80. A lower or second hinge 82 pivotably connects each roof rod 74 to a respective pole 76 along a third axis 84. The roof rod 74 has a first end 86 adjacent to the first hinge 78, and a second end 88 adjacent to the second hinge 82. The pole 76 has a third end 90 adjacent to the second hinge 82 and a fourth end 92 adjacent to a foot 94 that is configured to contact the ground.

Still referring to FIGS. 1 and 2, the fabric substrate 34 is divided into a section or sections 96 by a seam or seams 98. In some aspects, the section 96 may be a mesh material such as a scrim. In some aspects, the fabric substrate 34 may be formed of polyester, PVC (e.g. polyvinyl chloride) coated polyester, a flexible material laminated with a PVC layer, a woven cloth material, a translucent plastic material, or an organic material such as woven hemp fibers. In some aspects, the fabric substrate 34 may include at least one section 96 that is an open or ventilated mesh 100 (see FIG. 1), or a closed mesh 102. The open mesh 100 is configured to have open spaces between the material of the fabric substrate 34 so that air or a breeze can circulate through the open mesh 100 into the enclosure 68. The open mesh 100 is configured to provide a way to introduce sunlight through the open mesh 100 into the enclosure 68. The closed mesh 102 is configured to provide a way to significantly reduce or block sunlight, ventilation, heat transfer, and noise transfer from the exterior of the fabric substrate 34 entering the fabric substrate 34 through the closed mesh 102 (a.k.a. "wind breakers"). The closed mesh 102 can provide a higher degree of shade and/or privacy to a person within the enclosure 68 than the open mesh 100 can provide. In some aspects, the fabric substrate 34 includes the auxiliary strap 70 which includes snaps, fasteners or other attachment methods to facilitate attaching additional covers or sheets to the fabric substrate 34 (not shown). The auxiliary strap 70 provides a way to convert the section 96 of the fabric substrate 34 from a more ventilated configuration to a more private or warmer configuration. Additionally, the fastener on the auxiliary strap 70 may be configured to couple with a corresponding fastener attachment disposed on a door or other similar opening on a panel, such as an adjacent panel. For example, the entrance 46 may include a corresponding fastener attachment that is configured to be secured to the fastener of the auxiliary strap 70 in order to retain or keep open the entrance flap 46 as desired.

Figure 3:
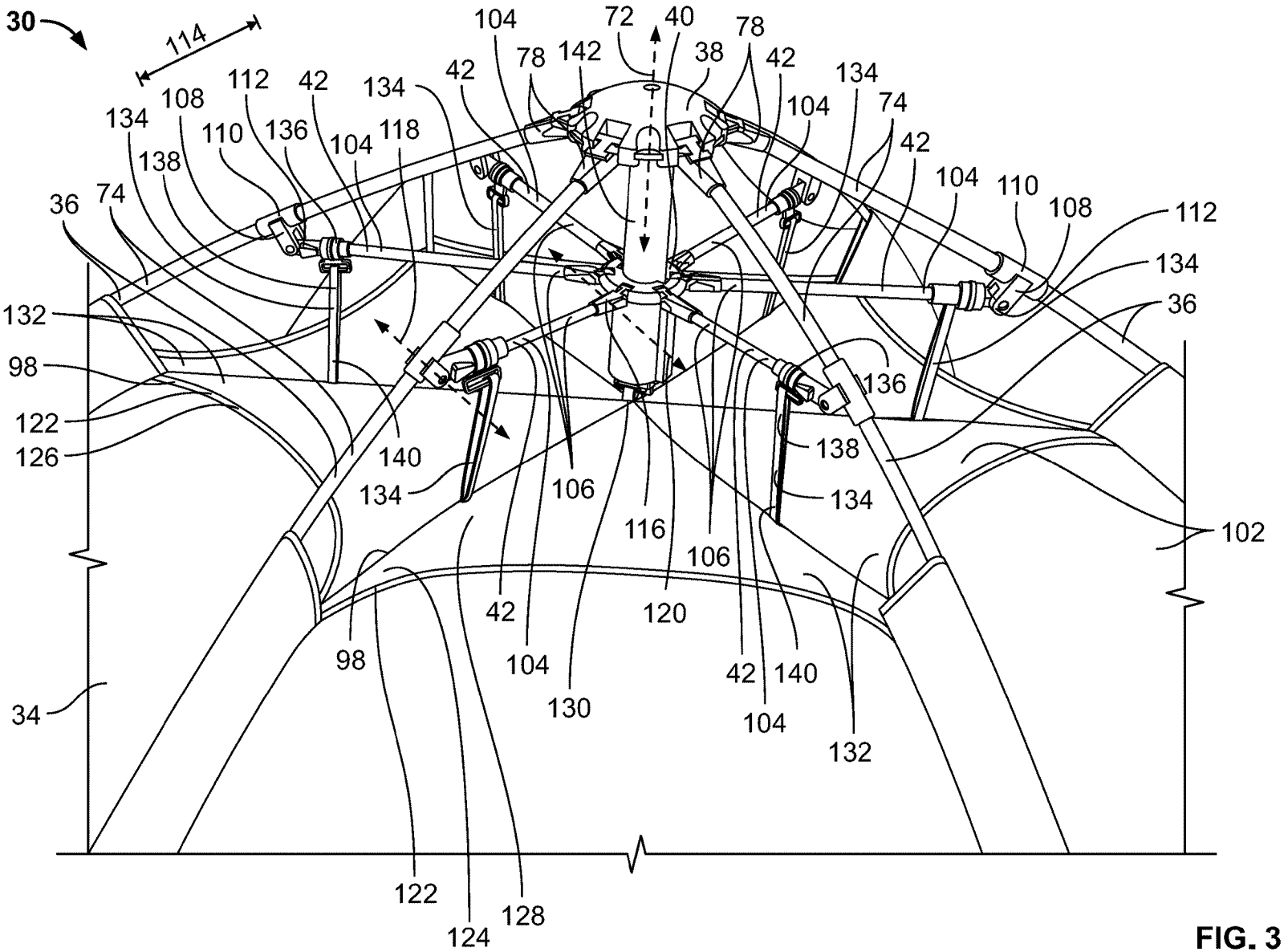
FIG. 3 is a perspective, detail view of a central post of the play pen of FIG. 1 in an assembled configuration.

Referring to FIG. 3, the central post 38 is connected to the roof rod 74 of each of the legs 36 by one of the first hinges 78. Each push rod 42 has an outer or fifth end 104 and an inner or sixth end 106. A push sleeve 108 includes a first sleeve 110 that is configured to be retained on the roof rod 74 and an outer or third hinge 112 that is connected to the fifth end 104 of one of the push rods 42. The first sleeve 110 is configured to slide along the roof rod 74 along a first length 114. Each of the plurality of push rods 42 is connected to the third hinge 112 and to an inner or fourth hinge 116. The third hinge 112 is connected to the fifth end 104 of the push rod 42 and to the first sleeve 110. The first sleeve 110 and the third hinge 112 are pivotally connected along a fourth axis 118. The fourth hinge 116 is connected to the sixth end 106 and pivotally connected to the collar 40 around a fifth axis 120. In some aspects, the various components are connected to one another by securing the components to one another. The various components of the frame 32 that are not pivotally connected to one another can be secured to one another by interference fit, by welding, by adhesive, by pinching, by a bayonet lock, by overmolding, or by another technique as would be appreciated by those of ordinary skill in the art.

The fabric substrate 34 has a top or first edge 122 that is connected to a canopy 124 by seams 98. The canopy 124 is a pliable, flexible fabric or mesh that is connected to the first edge 122 along an outer or second edge 126 located along the periphery of the canopy 124. In some aspects, the canopy 124 is the closed mesh 102 or the open mesh 100 or, alternatively, is a different closed mesh or a different open mesh. For example, the canopy 124 may comprise a denser, tighter, and/or less translucent mesh than the open mesh 100, since the canopy 124 is located so as to receive more direct sunlight when the play pen is situated outdoors in a sunny location. The canopy 124 has a middle region 128 and a central point 130 which intersects the first axis 72. In some aspects, the canopy 124 includes a segment or a plurality of segments 132 having at least one seam 98 that are sewn together along the at least one seam 98. A first strap or a plurality of first straps 134 include a C clip 136, a seventh end 138 located at a top of each strap 134 proximate a push rod 42, and an eighth end 140 which is opposite the seventh end 138. The first straps 134 are secured to the middle region 128 at the eighth end 140. The C clip 136 is configured to be selectively retained on the push rods 42.

Figure 4:
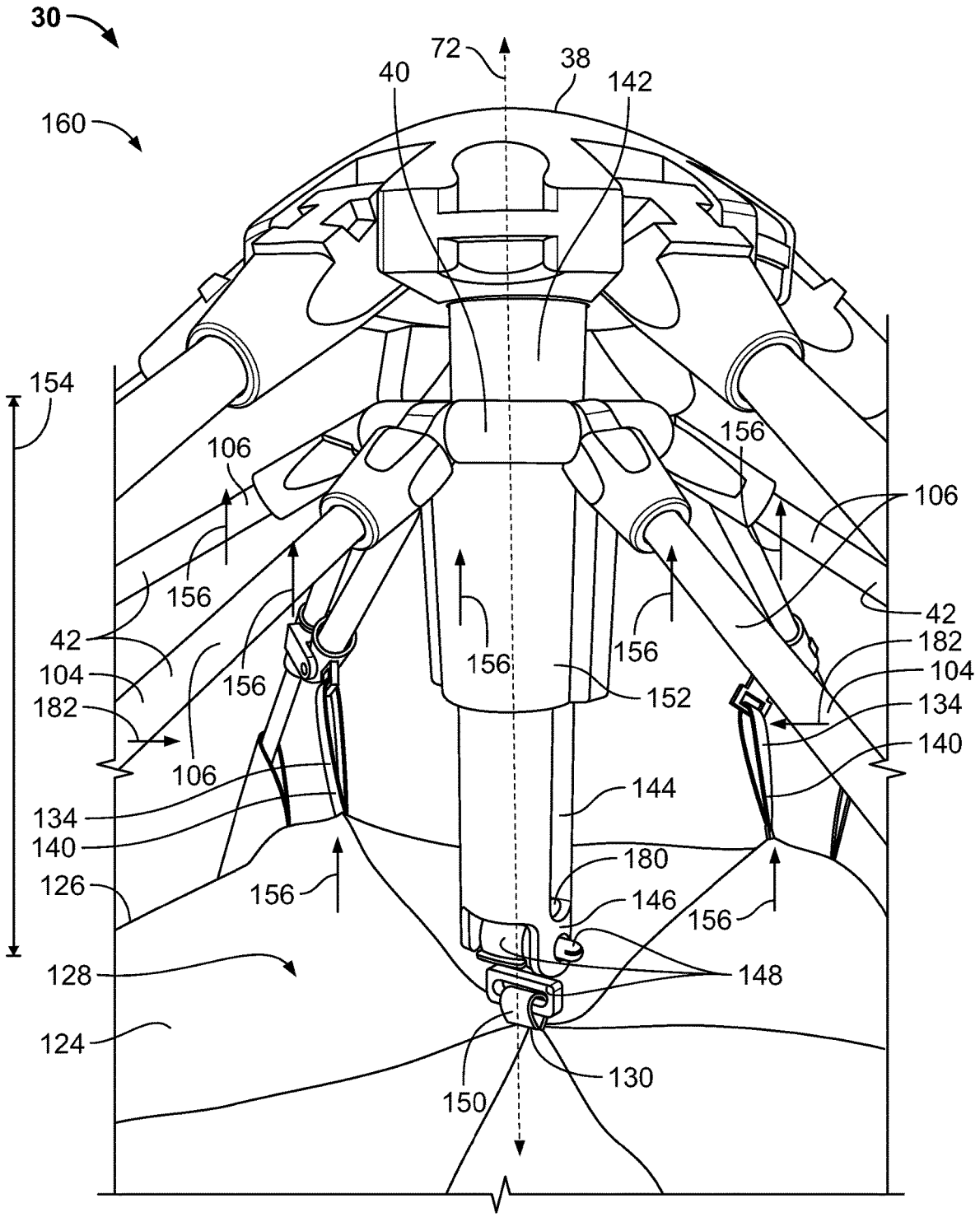
FIG. 4 is another perspective, detail view of the central post of the play pen of FIG. 1 in a pre-assembled configuration.

Referring to FIG. 4, the central post 38 includes a first shaft 142 with an at least one recessed slot 144 which is on the exterior surface of the first shaft 142. The first shaft 142 includes at least one shaft extension 146 that extends toward the central point 130 of the canopy 124. A central or first fastener 148 is configured to be releasably secured to the at least one shaft extension 146. In some aspects, the first fastener 148 is secured to a central or second strap 150 which is secured to the central point 130 of the canopy 124. In some aspects, the first fastener 148 is directly secured to the central point 130 of the canopy 124 (not shown) without the use of the second strap 150.

The collar 40 has an at least one internal or first retainer 152 that is configured to slidably engage the at least one recessed slot 144 such that the collar 40 is retained in or on the first shaft 142 of the central post 38, but allows the collar 40 to be raised or lowered along a second length 154 of the first shaft 142. When the collar 40 is moved away from the central point 130 in an upward direction 156, the sixth end 106 of each of the plurality of push rods 42 translates upward, drawing in the opposite fifth end 104 inward toward the first axis 72. This in turn lifts the eighth end 140 of the plurality of first straps 134 in the upward direction 156. When the eighth end 140 is lifted, the middle region 128 of the canopy 124 lifts up higher than the second edge 126 and the central point 130 of the canopy 124.

Figure 5:
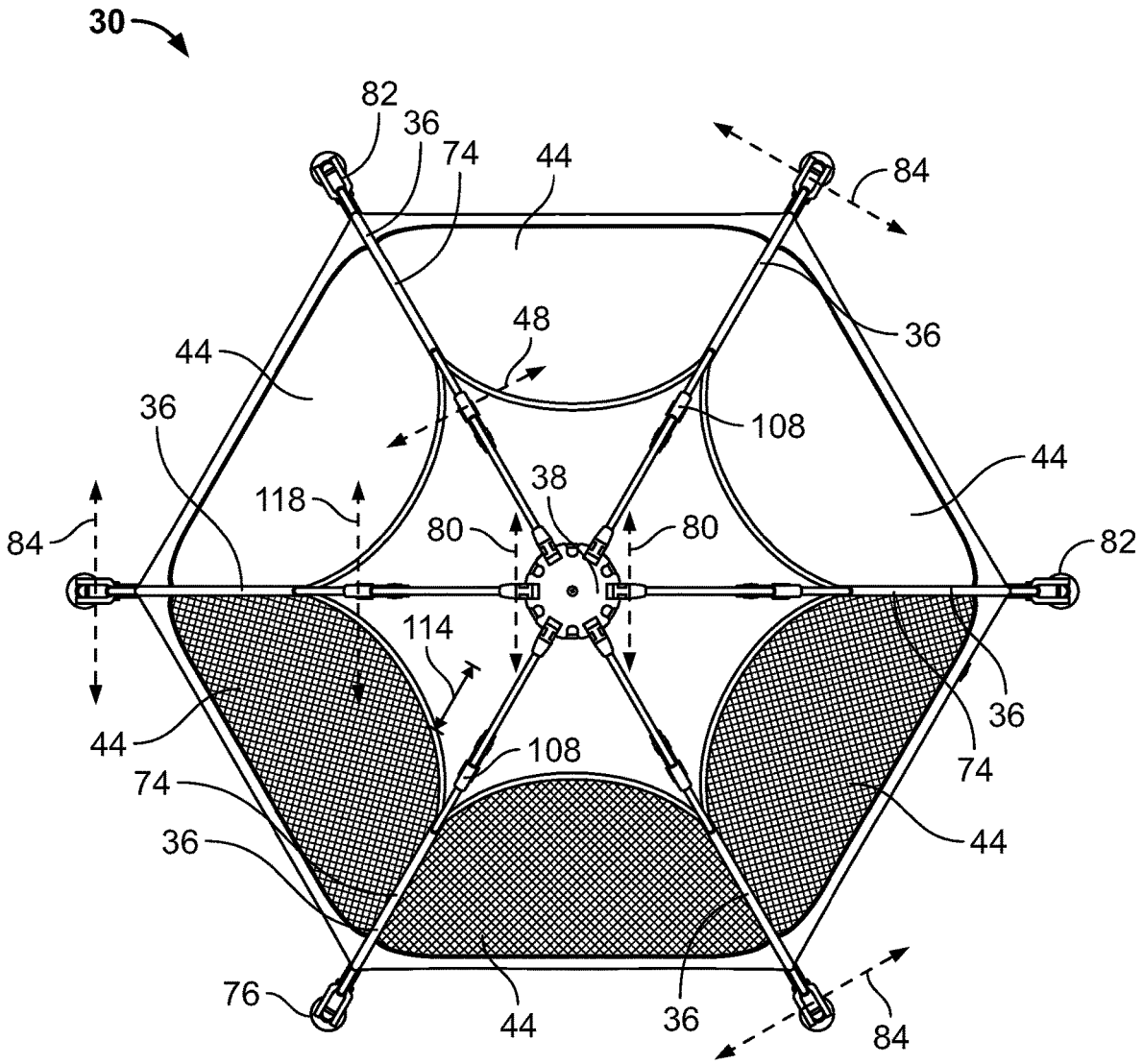
FIG. 5 is a top plan view of the play pen of FIG. 1.

Referring to FIG. 5, the central post 38 is connected to each of the plurality of legs 36, and the plurality of portions 44 are located between each adjacent pair of legs 36. The second axis 80, the third axis 84, and the fourth axis 118 are shown with respect to the central post 38. The second axis 80 allows each roof rod 74 to pivot closer or farther away from the central post 38. The third axis 84 allows each pole 76 to pivot closer or farther away from the central post 38. The fourth axis 118 provides a way for the push sleeve 108 to slide along the first length 114 as the push rod 42 moves (see also FIG. 3).

Figure 6:
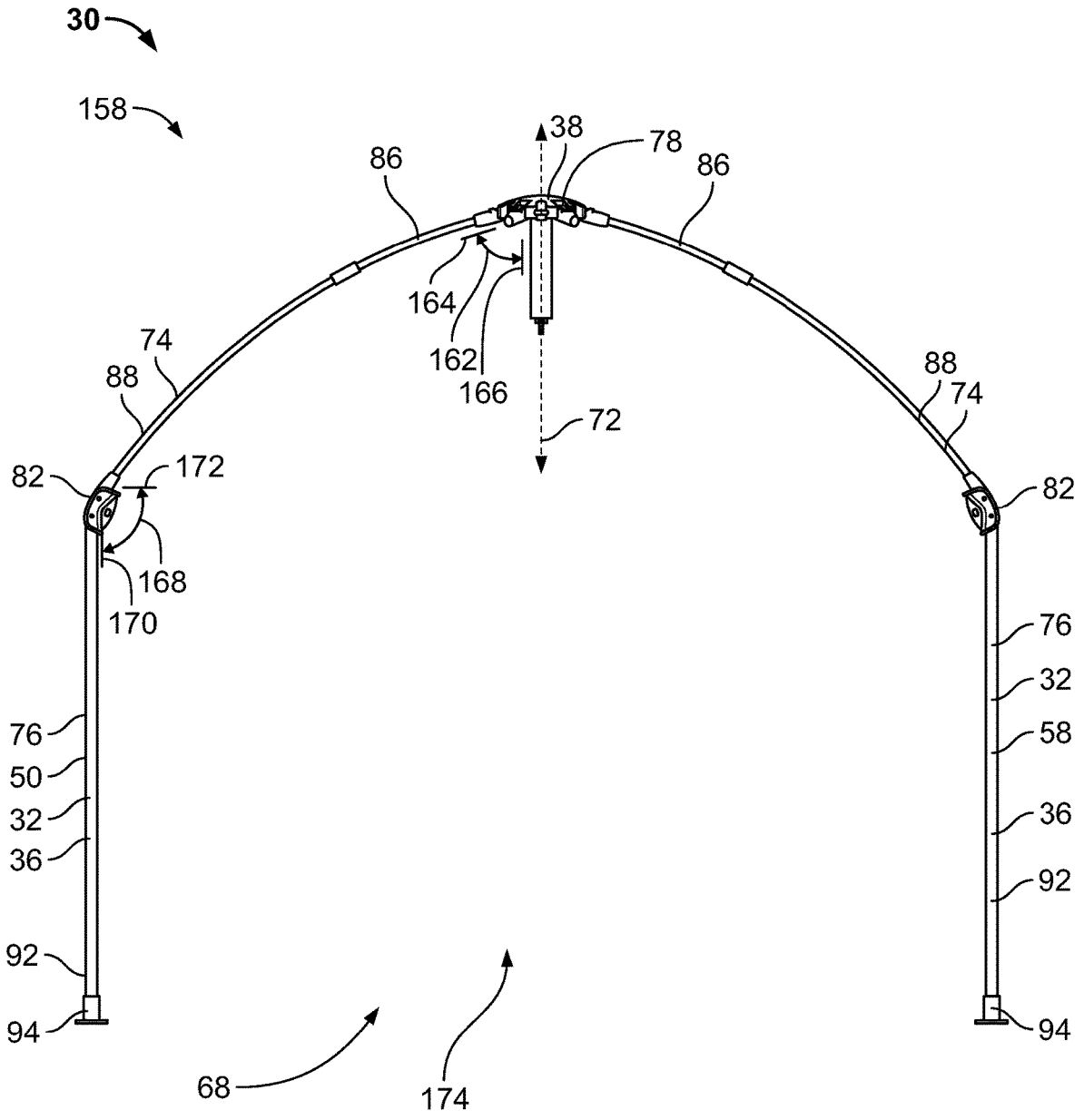
FIG. 6 is a side view of a portion of a frame of the play pen of FIG. 1.
Figure 7:
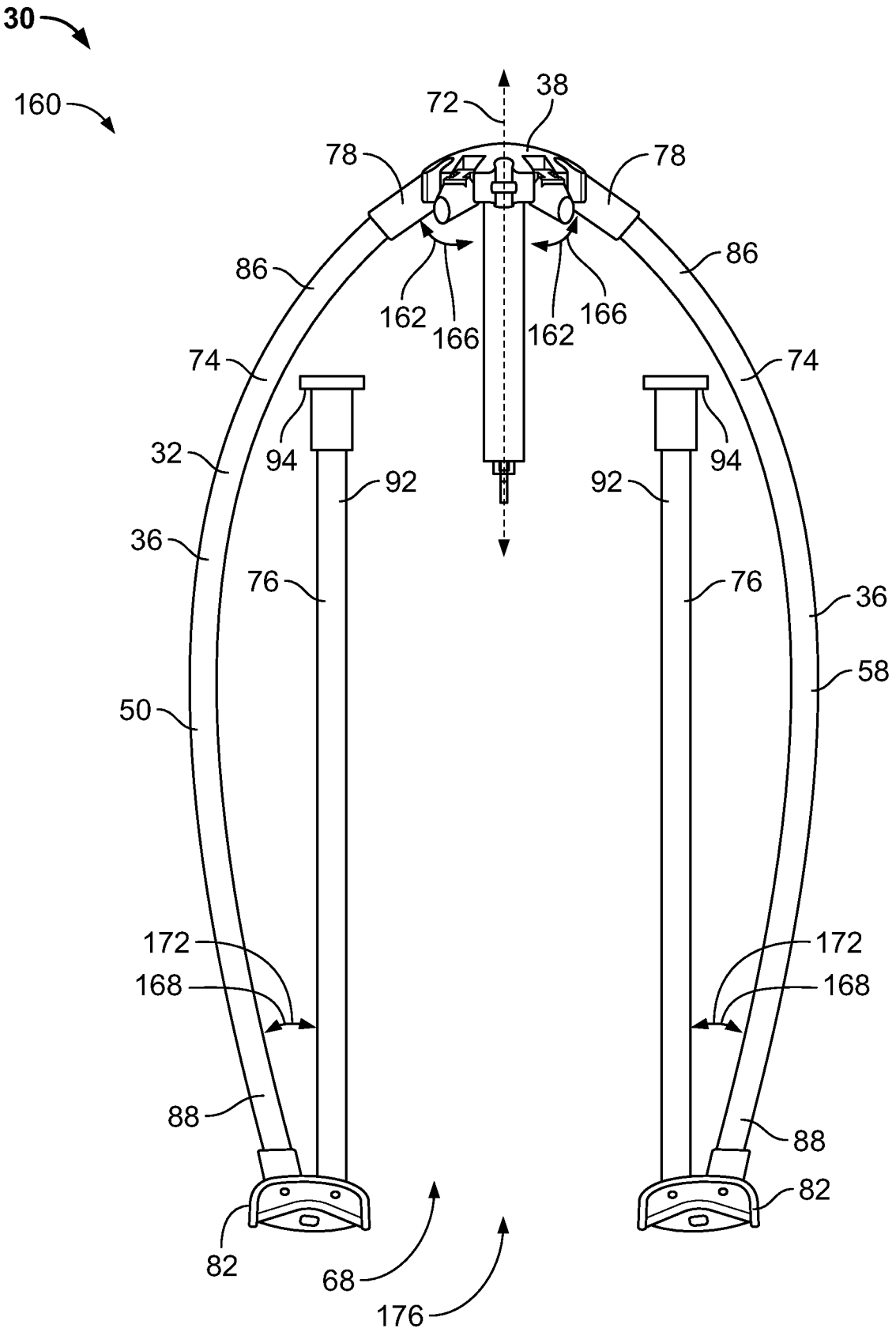
FIG. 7 is a side view of the frame of FIG. 6 in a pre-assembled configuration.

Referring to FIGS. 6 and 7, one of the legs 36 at the front 50 of the play pen 30 and the opposite leg 36 at the rear 58 of the play pen 30 are shown in reference to the central post 38 with the remainder of the frame 32 and the entire fabric substrate 34 removed to illustrate an extended, final, or assembled configuration 158 (FIG. 6) versus a storage, collapsed or pre-assembled configuration 160 (FIG. 7). The first hinge 78 is configured to have a first range of motion 162 between the second end 88 of the roof rod 74 and the first axis 72, which define a first maximum angle 164 and a first minimum angle 166. In some aspects, the first maximum angle 164 may be limited to a maximum of less than 180 degrees, or less than 165 degrees, or less than 150 degrees, or less than 135 degrees, or less than 120 degrees, or less than 105 degrees. In some aspects, the first maximum angle 164 may be limited to a maximum of less than 90 degrees, or less than 75 degrees, or less than 60 degrees, or less than 45 degrees, or less than 30 degrees.

The second hinge 82 is configured to have a second range of motion 168 between the fourth end 92 of the pole 76 and the first end 86 of the roof rod 74, which define a second maximum angle 170 and a second minimum angle 172. In some aspects, the second maximum angle 170 may be limited to less than 180 degrees, or less than 165 degrees, or less than 150 degrees, or less than 135 degrees, or less than 120 degrees, or less than 105 degrees. When the fabric substrate 34 is present, the enclosure 68 is located generally between the leg 36 from the front 50 of the play pen 30 and the leg 36 from the rear 58 of the play pen 30. The assembled configuration 158 is defined as when the first range of motion 162 for each leg 36 is at the first maximum angle 164 and the second range of motion 168 for each leg 36 is at the second maximum angle 170 (see FIG. 6). The pre-assembled configuration 160 is defined as when the first range of motion 162 for each leg 36 is at the first minimum angle 166 and the second range of motion 168 for each leg 36 is at the second minimum angle 172 (see FIG. 7). When the play pen 30 is in the assembled configuration 158, the enclosure 68 has a maximum volume 174 (FIG. 6). When the play pen 30 is in the pre-assembled configuration 160, the enclosure 68 has a minimum volume 176 (FIG. 7).

Figure 8:
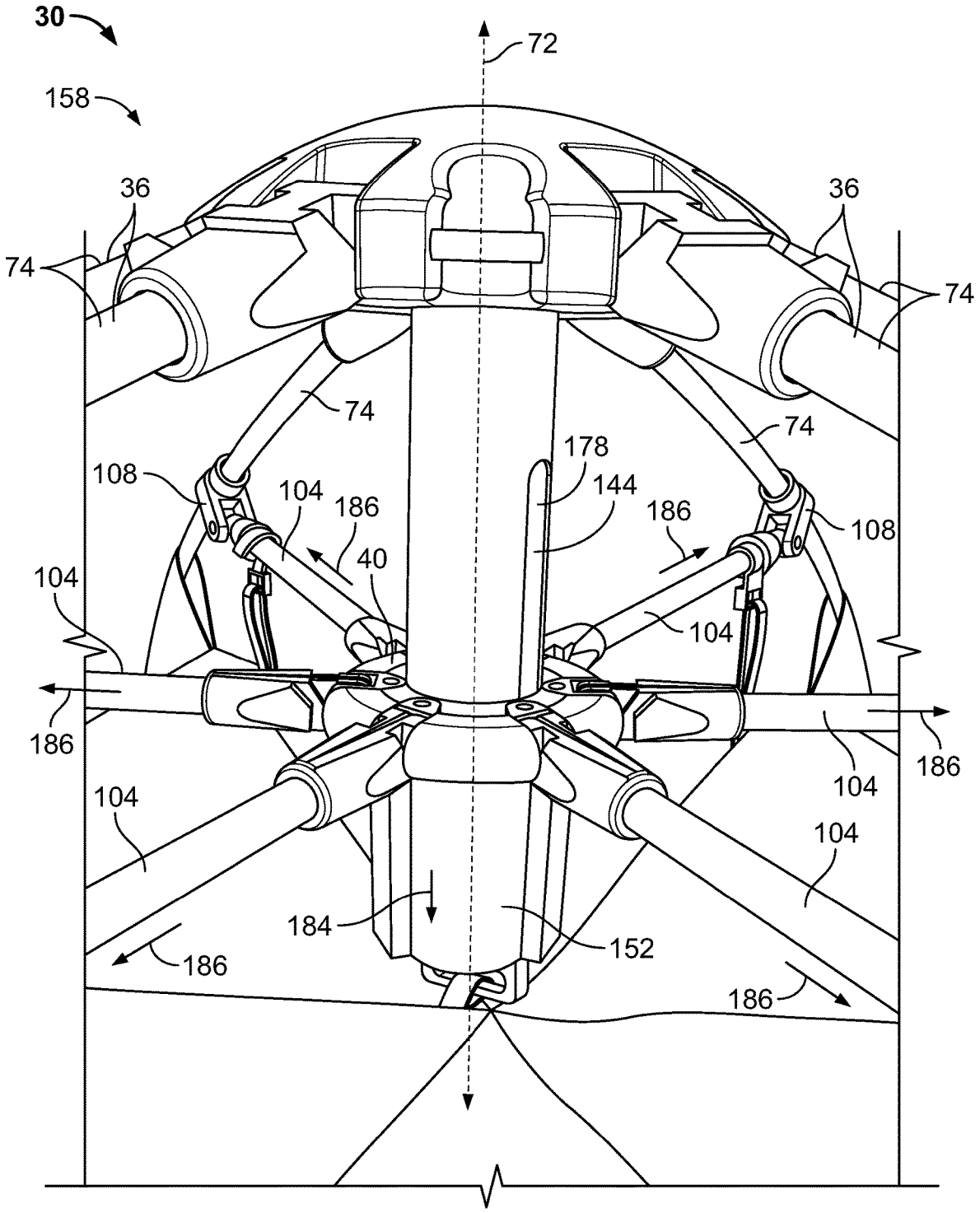
FIG. 8 is another perspective, detail view of the central post of the play pen of FIG. 1 in the assembled configuration.

Referring to FIGS. 4 and 8, the at least one recessed slot 144 has an upper or ninth end 178 (see FIG. 8) and a lower or tenth end 180 (see FIG. 4). When the at least one first retainer 152 of the collar 40 engages the at least one recessed slot 144 at the ninth end 178, the play pen 30 is in the pre-assembled configuration 160 (see FIG. 4). When the at least one first retainer 152 of the collar 40 engages the at least one recessed slot 144 at the tenth end 180, the play pen 30 is in the assembled configuration 158 (see FIG. 8). When the collar 40 moves in the upward direction 156 (see FIG. 4) away from the central point 130, the fifth end 104 of each push rod 42 moves in an inward direction 182 (see FIG. 4) toward the first axis 72. When the collar 40 moves in a downward direction 184 toward the central point 130, the fifth end 104 of each push rod 42 moves in an outward direction 186 away from the first axis 72. Each push rod 42 pushes or pulls on the respective roof rod 74 via the push sleeve 108 to assist in moving the plurality of legs 36 between the assembled configuration 158 and the pre-assembled configuration 160 (see also FIGS. 6 and 7).

Figure 9:
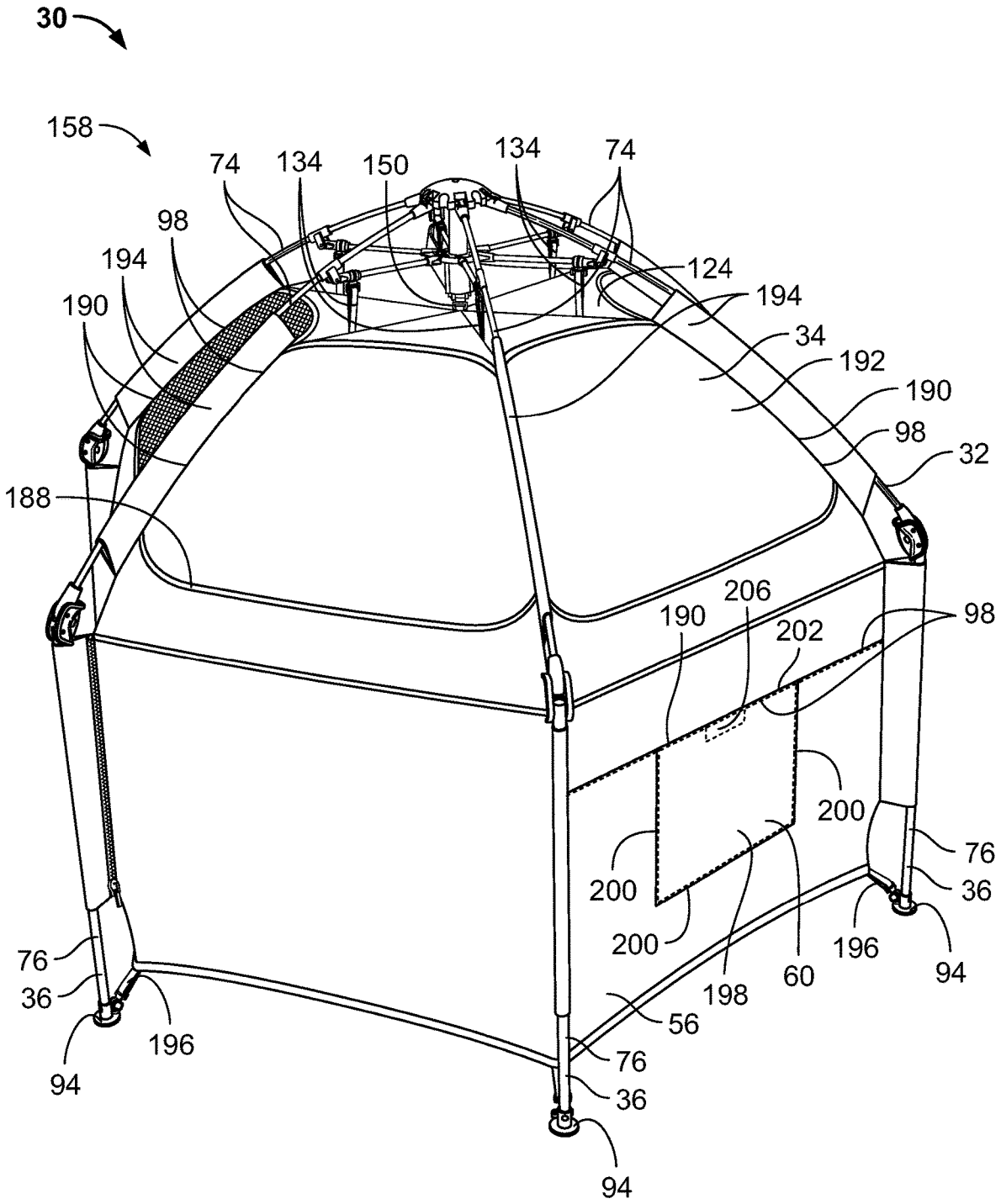
FIG. 9 is a left, rear perspective view of the play pen of FIG. 1 with a display pocket in a closed configuration.
Figure 10:
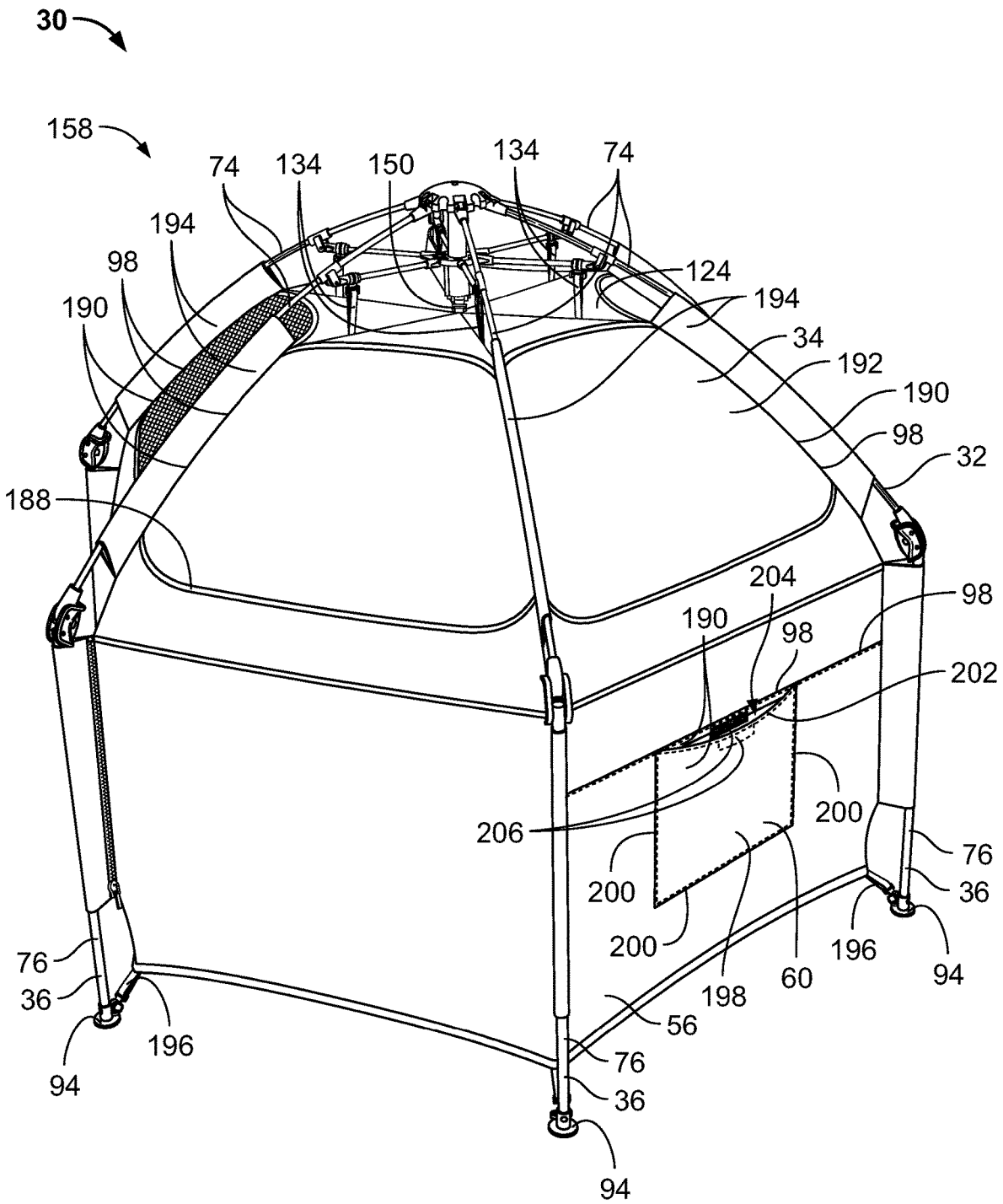
FIG. 10 is a left, rear perspective view of the play pen of FIG. 1 with the display pocket in an open configuration.
Figure 11:
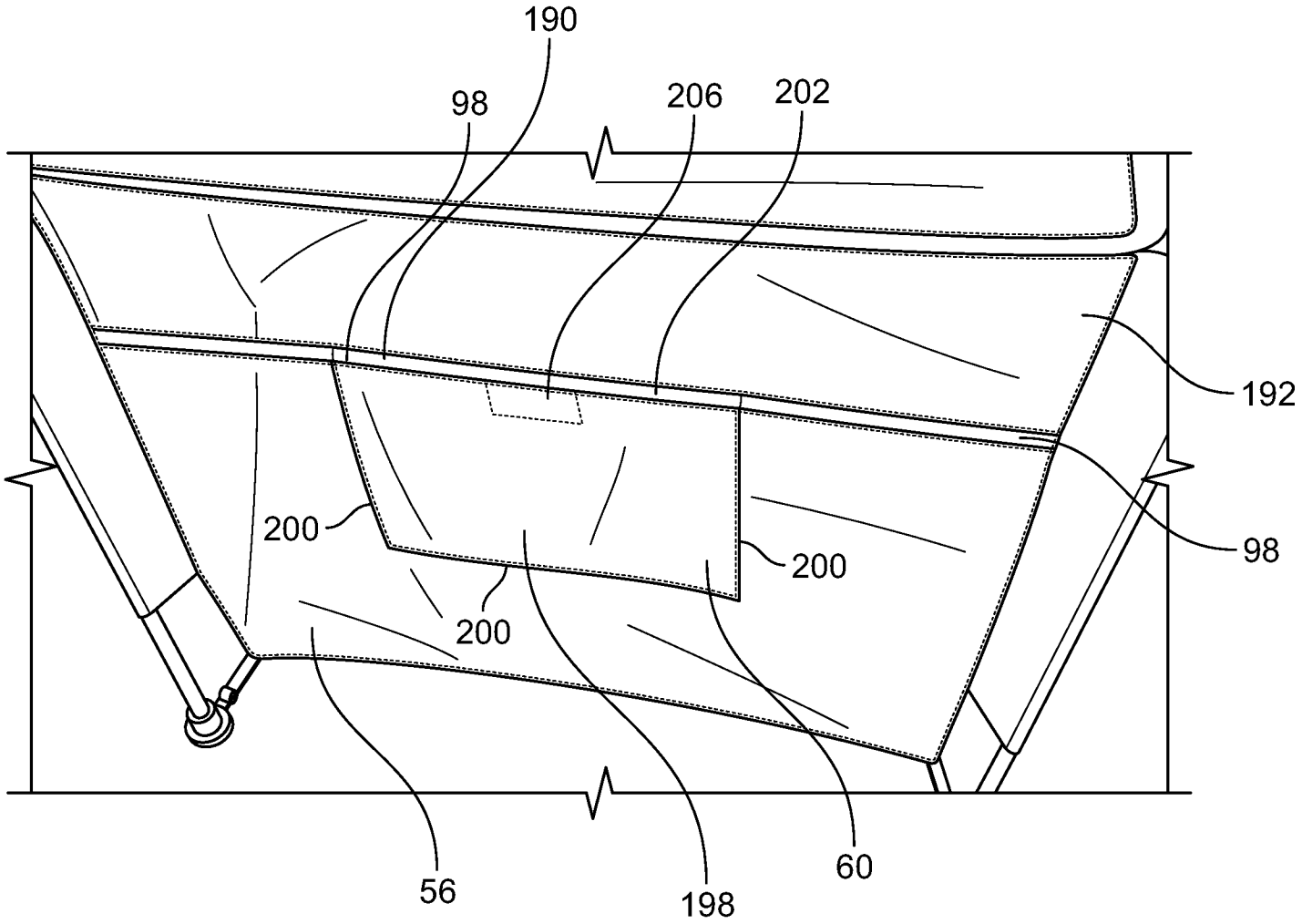
FIG. 11 is a detail, rear perspective view of the play pen of FIG. 1 with the display pocket in the closed configuration.
Figure 12:
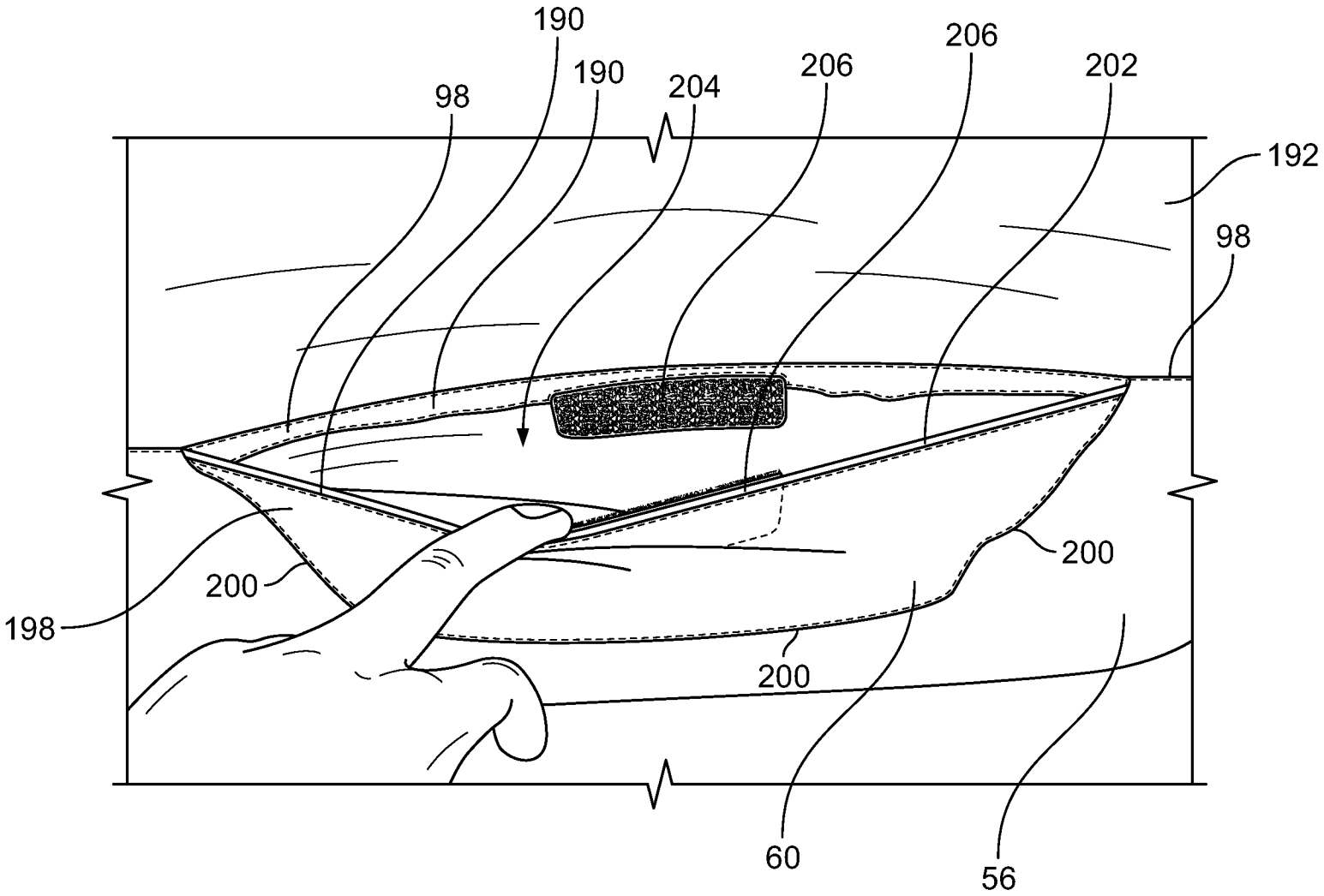
FIG. 12 is a detail, rear perspective view of the play pen of FIG. 1 with the display pocket in the open configuration.
Figure 13:
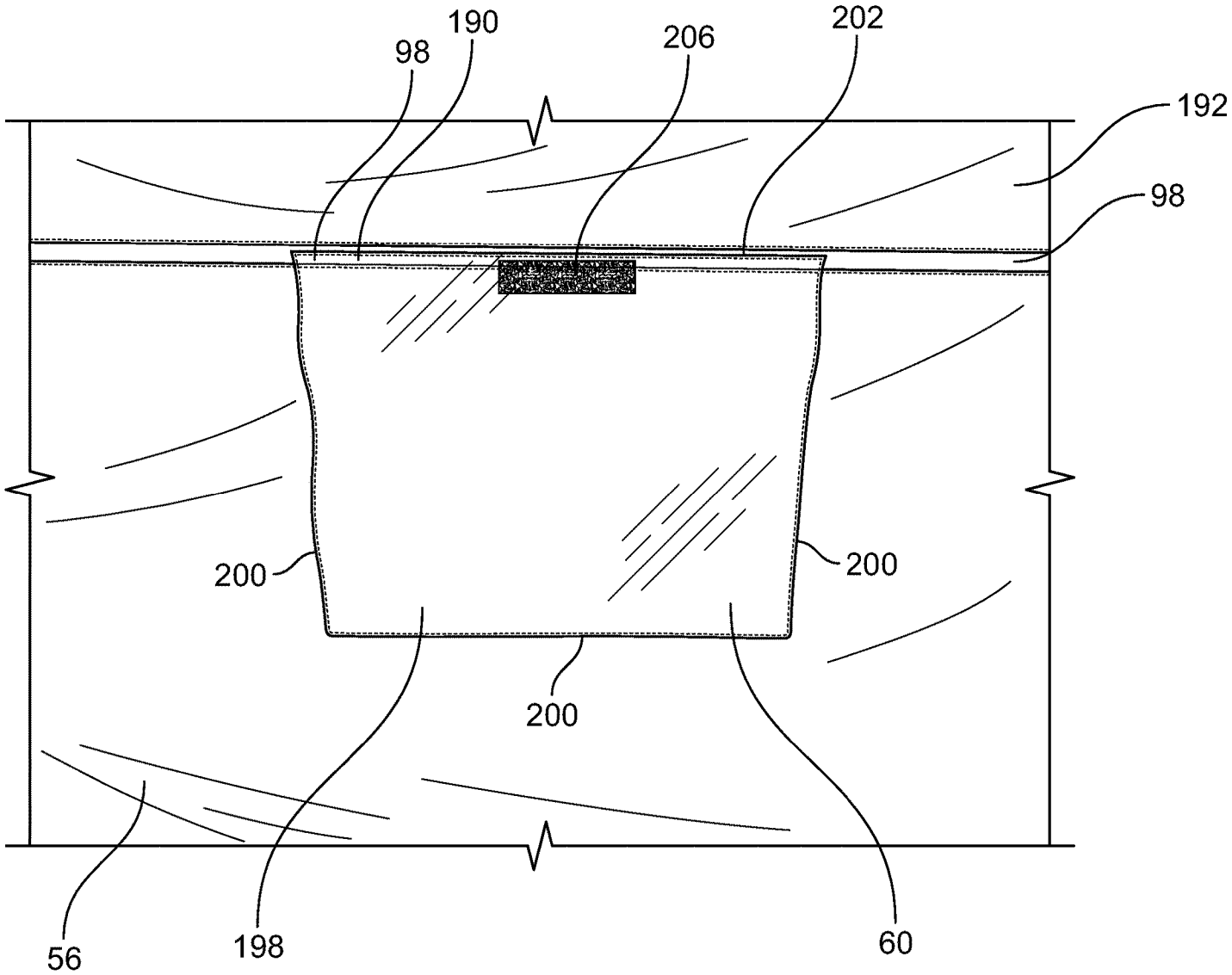
FIG. 13 is a detail, side view of the play pen of FIG. 1 with the display pocket in the closed configuration.

Referring to FIGS. 9 and 10, the seams 98 of the fabric substrate 34 can be either a reinforced edge 188 or a secured edge 190. The reinforced edge 188 reinforces the seam 98 by sewing, welding, overmolding, adhesive, adding a webbing of material, or by using another technique as would be appreciated by one of ordinary skill in the art. The reinforced edge 188 may be stronger and more difficult to tear than the rest of the fabric substrate 34. The secured edge 190 is defined by the seam 98 being configured to be selectively opened or closed to detach or attach one of the sections 96 of the fabric substrate 34 to another section 96 of the fabric substrate 34. In some aspects, at least one of the sections 96 that are between two adjacent roof rods 74 can include a secured edge 190 so that the at least one section 96 can be opened or closed selectively to allow more or less sunlight, ventilation, and fresh air into the enclosure 68 as desired. Referring to FIG. 1, for example, the first portion 48 has the entrance 46 which includes the seam 98 with the secured edge 190. In some aspects, the secured edge 190 is a zipper, or a series of snap closures, or a collection of hooks and loops. In some aspects, the entrance 46 includes a seam 98 with a secured edge 190 which is selectively opened or closed by a zipper.

Still referring to FIGS. 9 and 10, the fabric substrate 34 has a main or first body 192 that is secured to the frame 32 in part by a plurality of second sleeves 194 that are configured to be retained by respective ones of the poles 76 or roof rods 74. In some aspects, each of the plurality of second sleeves 194 is secured to the main body 192 of the fabric substrate 34 by the secured edge 190 of the seam 98 so that each of the plurality of second sleeves 194 can be selectively detached from the main body 192. In some aspects, the main body 192 of the fabric substrate 34 is secured to the feet 94 of each of the plurality of legs 36 by a plurality of third straps 196. In the assembled configuration 158, the plurality of second sleeves 194, the plurality of first straps 134, the second strap 150, and the plurality of third straps 196 collectively hold the main body 192 and the canopy 124 in an expanded, taught shape when the play pen 30 is in the assembled configuration 158.

Referring to FIGS. 9-13, the fourth portion 56 (see FIGS. 9 and 10) has the display pocket 60 depending downwardly from a seam 98 that extends horizontally along the fourth portion 56. The display pocket 60 has a cover sheet 198 located inwardly of the main body 192 that is transparent or translucent so that an item placed in the display pocket 60 is visible to a person situated inside the play pen 30. The cover sheet 198 may have an at least one third edge 200 which is secured to the main body 192 in the fourth portion 56 by sewing, welding, adhesives, adding a webbing of material, or overmolding. The cover sheet 198 has an at least one fourth edge 202 which is either not secured to the main body 192 or is secured at the seam 98 by the secured edge 190 so that the at least one fourth edge 202 is selectively opened (see FIGS. 10 and 12) to allow access to a first pocket 204 formed between the main body 192 and the cover sheet 198. In some aspects, the display pocket 60 includes an at least one second fastener 206. The at least one second fastener 206 may be attached to the main body 192 and face the first pocket 204, or may be attached to the cover sheet 198 and face the first pocket 204, or may be attached to both. In some aspects, the at least one second fastener 206 is a series of snaps, hooks and loops, lace, or another attachment mechanism as would be appreciated by one of ordinary skill in the art. In some aspects, the first pocket 204 of the display pocket 60 is large enough and configured to retain a tablet-type computer so that child appropriate entertainment or other entertainment can be viewed on the screen of the tablet. In some aspects, the display pocket 60 faces the interior of the main body 192 of the play pen 30. In some aspects, the display pocket 60 faces the exterior of the main body 192 of the play pen 30. Additionally, although the display pocket 60 is shown and described as being on the fourth portion 56, which is across the play pen 30 from the portion containing the entrance 46, it will be appreciated that the display pocket 60 or one or more additional display pockets 60 may be situated on one or more of the other portions of the play pen 30.

Figure 14:
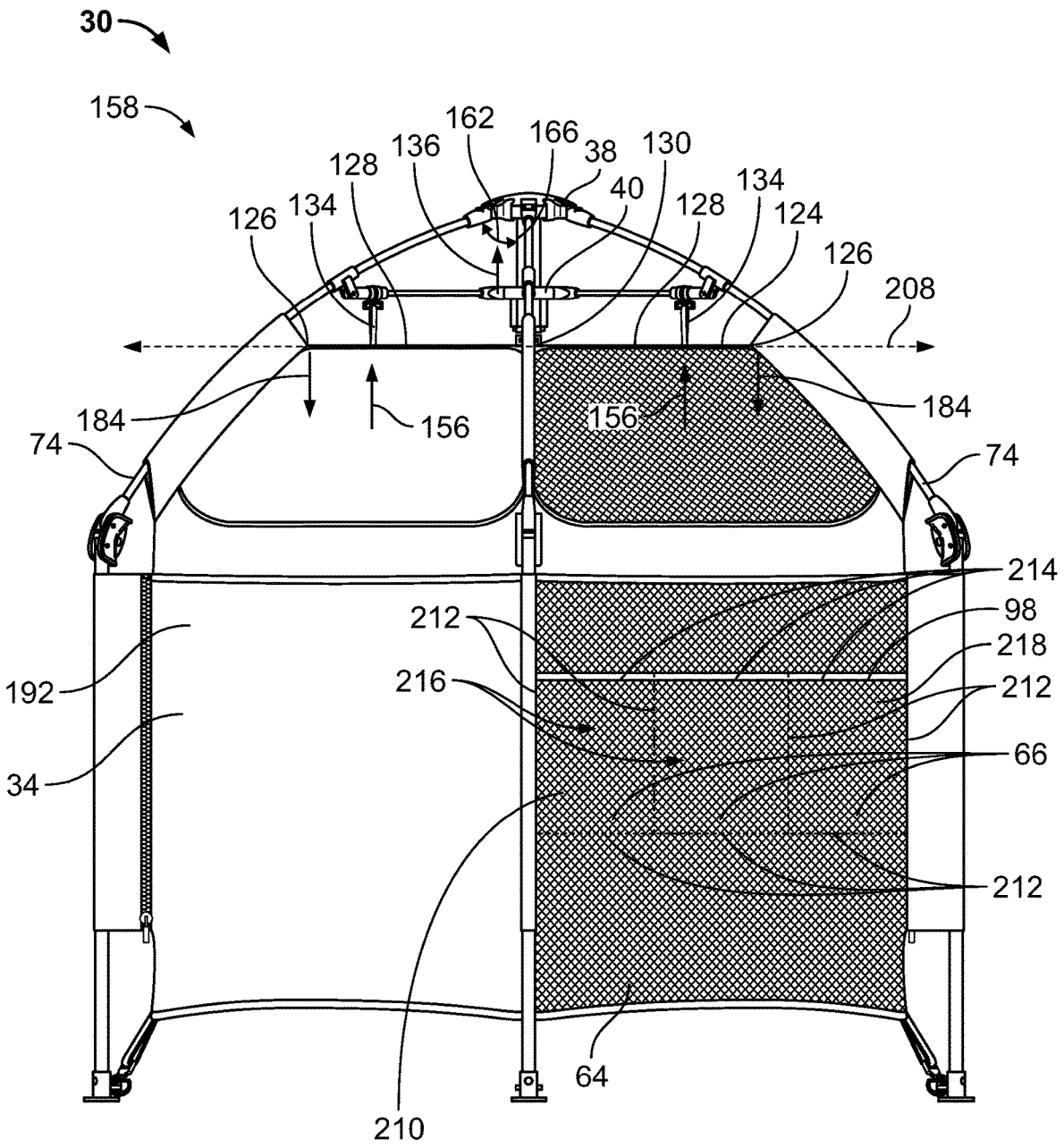
FIG. 14 is left elevational view of the play pen of FIG. 1.

Referring to FIG. 14, a first horizontal plane 208 extends horizontally and intersects the central point 130 of the canopy 124. In some aspects, the first horizontal plane 208 intersects the second edge 126, the middle region 128, and the central point 130 when the play pen 30 is in the assembled configuration 158. When the collar 40 moves in the upward direction 156 to convert the play pen 30 from the assembled configuration 158 to the pre-assembled configuration 160 (see FIG. 4), the plurality of first straps 134 move in the upward direction 156 with respect to the central point 130, which is indirectly attached to the central post 38. In addition, when the collar 40 moves in the upward direction 156, the second edge 126 of the canopy 124 moves in the downward direction 184 as the roof rods 74 begin to move toward the first minimum angle 166. Therefore, when the second edge 126, the middle region 128, and the central point 130 of the canopy 124 intersect the first horizontal plane 208 in the assembled configuration 158, the middle region 128 moves above the first horizontal plane 208 and the second edge 126 moves below the first horizontal plane 208 as the collar 40 moves the play pen 30 toward the pre-assembled configuration 160.

Figure 15:
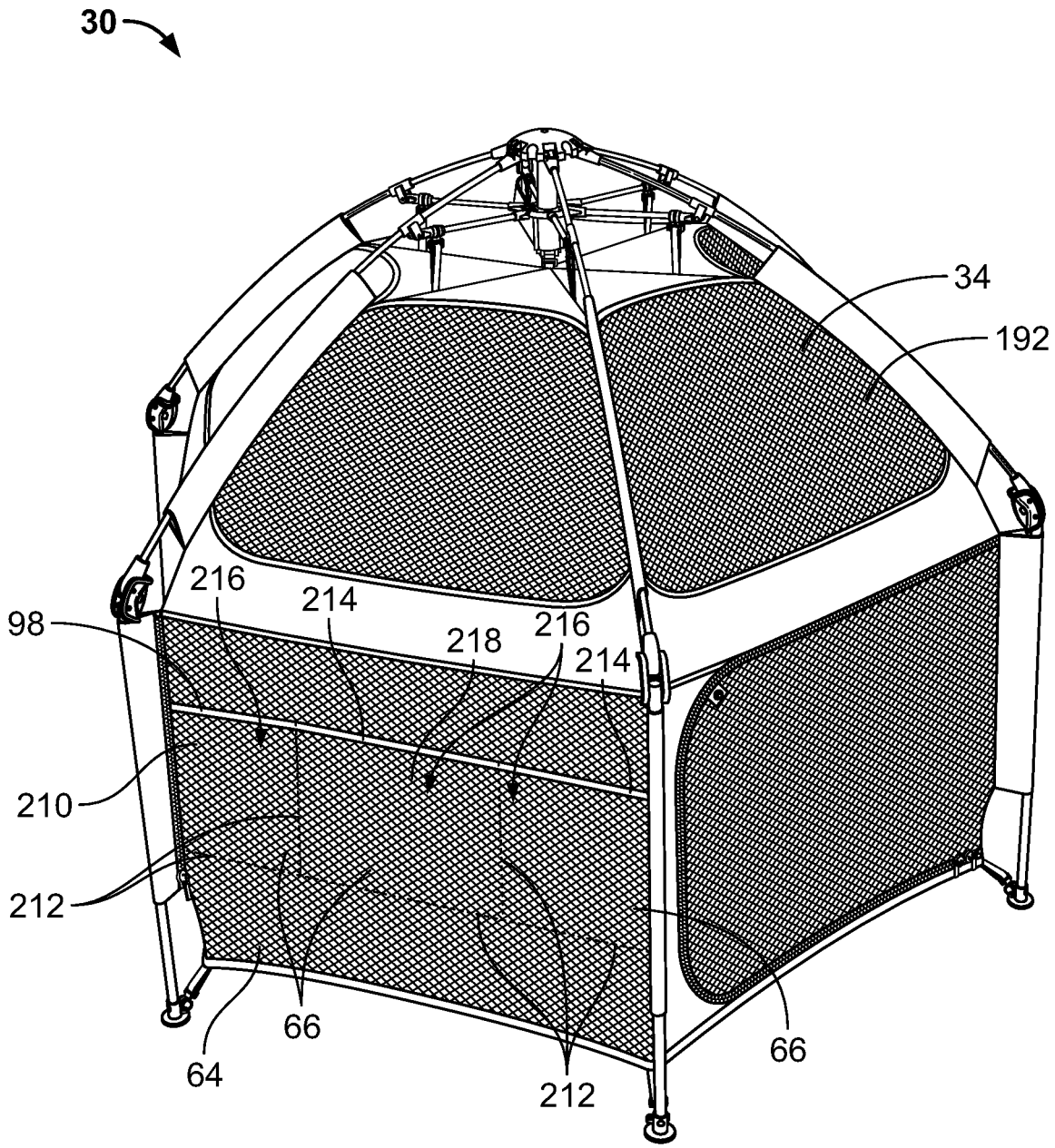
FIG. 15 is front, right perspective view of the play pen of FIG. 1.

Referring to FIGS. 14 and 15, the sixth portion 64 of the main body 192 of the fabric substrate 34 includes the plurality of storage pockets 66. The sixth portion 64 may include the seam 98 that extends horizontally along the sixth portion 64. The plurality of storage pockets 66 include at least one storage sheet 210 which may be transparent, opaque, or semi-opaque. The at least one storage sheet 210 is secured to the main body 192 of the fabric substrate 34 along an at least one fifth edge 212 by sewing, welding, adhesives, adding a webbing of material, or overmolding. The at least one storage sheet 210 has an at least one sixth edge 214 which is either not secured to the main body 192 or is secured at the seam 98 by the secured edge 190 so that the at least one sixth edge 214 is selectively opened to allow access to an at least one second pocket 216 formed between the main body 192 and the at least one storage sheet 210. In some aspects, at least one of the plurality of storage pockets 66 includes an at least one third fastener 218. The at least one third fastener 218 may be attached to the main body 192 and face the at least one second pocket 216, or may be attached to the at least one storage sheet 210 and face the at least one second pocket 216, or may be attached to both. In some aspects, the at least one third fastener 218 is a series of snaps, hooks and loops, lace, or other fastener. In some aspects, the at least one second pocket 216 of the plurality of storage pockets 66 is large enough and configured to retain a tablet-type computer so that the computer used in the display pocket 60 can be stored in between uses in the at least one storage pocket 66. In some aspects, the at least one storage pocket 66 faces the interior of the main body 192 of the play pen 30, and in some aspects, the at least one storage pocket 66 faces the exterior of the main body 192 of the play pen 30.

Figure 16:
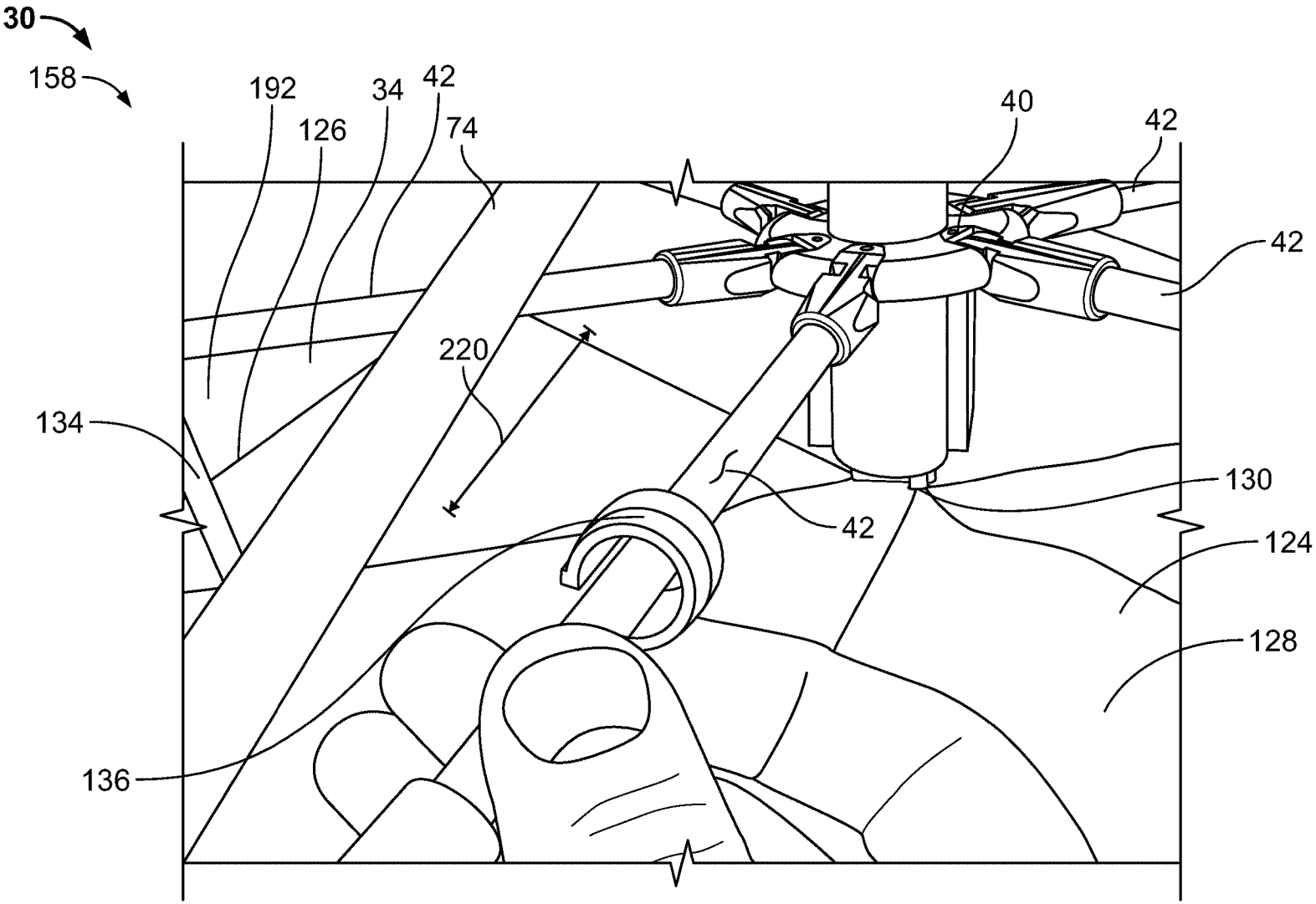
FIG. 16 is a detail, perspective view of a C clip of the play pen of FIG. 1 in the process of being unsecured from a push rod.
Figure 17:
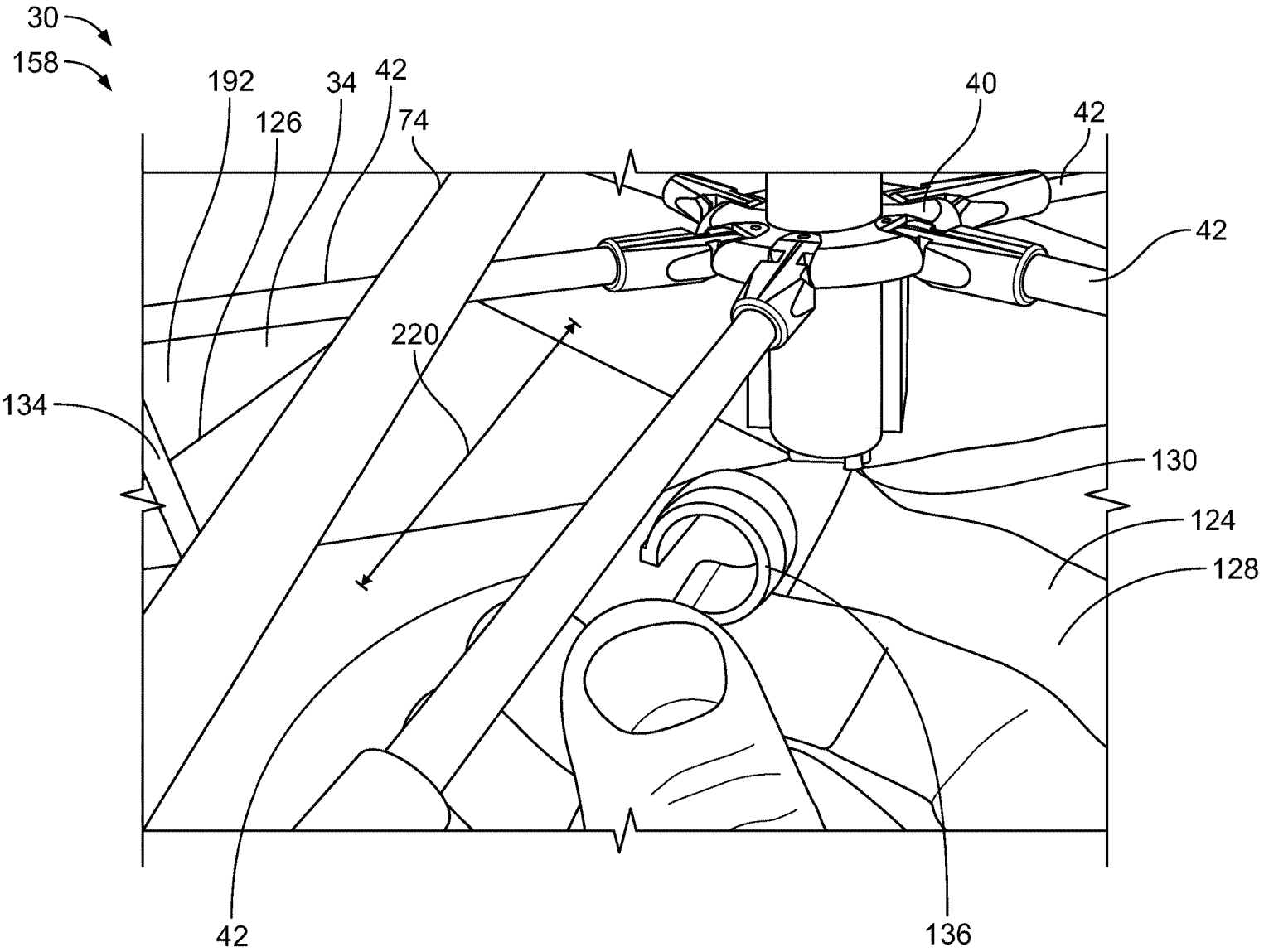
FIG. 17 is detail, perspective view of the C clip of FIG. 16 having been unsecured from the push rod.

Referring to FIGS. 16 and 17, the C clip 136 utilized with the plurality of first straps 134 is shown secured to the push rod 42 (FIG. 16) and removed from the push rod 42 (FIG. 17). The C clip 136 snaps onto or off the push rod 42, and can slide along a third length 220 of the push rod 42 as the play pen 30 is moved between an expanded and a collapsed state. Since the C clip 136 is readily removed, the attachment and removal of the main body 192 and/or the canopy 124 of the fabric substrate 34 is easier. Since the C clip 136 allows the plurality of first straps 134 (see FIG. 3) to slide along the third length 220 while still remaining tethered to the middle region 128 of the canopy 124, the canopy 124 can retain an aesthetically pleasing appearance of continuity as the canopy 124 is placed into the assembled configuration 158 and the pre-assembled configuration 160 (see FIG. 7). This also provides a tidy and well-organized way to store the canopy 124 while in storage, since the plurality of first straps 134 apply a lifting force in a predetermined manner so that the canopy 124 folds in a desired manner, without folding over on itself or snagging or binding on any members of the frame 32. Additionally, the C clip 136 may be replaced with one or more other suitable connectors that secure a strap to a respective push rod 42. For example, the C clip 136 may be replaced with a different connector having a closed, cylindrical portion at its end that is slid on to an end of the push rod 42 before the push rod 42 is secured at one of its ends 104, 106 to another portion of the frame 32.

The members of the frame 32 disclosed herein may have generally circular exterior cross-sections. Similarly, the C clip 136 or whatever connector is used may be a generally circular interior cross-section sized slightly larger so as to permit sliding engagement between the connector and the members of the frame 32. In yet another aspect, the frame member and/or the connector may have different cross-sections such as rectangular, square, polygonal, triangular, hexagonal, octagonal, oblong, or some other shape. In that case, the frame member and connector may have similarly-shaped cross-sections. Alternatively, the frame member and connector may have differently-shaped cross-sections, as long as the connector is still free to slidably engage along a length of the frame member.

Although the play pen 30 is illustrated with the display pocket 60, the plurality of storage pockets 66, and the entrance 46 on the fourth portion 56, the sixth portion 64, and the first portion 48 respectively, these features can be arranged anywhere on the main body 192 of the fabric substrate 34 in alternative aspects. In some aspects, the plurality of legs 36 can be more or less than six. In some aspects, one or more of the sections 96 of the main body 192 can be open, without the open mesh 100 or the closed mesh 102. In some aspects, the play pen 30 can have none or more than one of the display pocket 60, the entrance 46, or the plurality of storage pockets 66.

It will be appreciated by those skilled in the art that while the invention has been described above in connection with particular aspects and examples, the invention is not necessarily so limited, and that numerous other aspects, examples, uses, modifications and departures from the aspects, examples and uses are intended to be encompassed by the present disclosure and claims. The entire disclosure of each patent and publication cited herein is incorporated by reference, as if each such patent or publication were individually incorporated by reference herein.

We claim:

1. A play pen comprising:

a frame having a plurality of legs, a central post with a first axis and having a first fastener, a collar that can selectively slide along the central post, and a plurality of push rods;

a fabric substrate with a main body and having a first edge, a flexible canopy having a second edge, a central point, and a middle region between the central point and the second edge; and a plurality of first straps with a clip at a first end that is secured to one of the plurality of push rods, the first end is opposite a second end that is secured to the middle region, wherein the central point intersects the first axis, and the central point is secured to the first fastener, wherein the first edge and the second edge are secured together along a seam, wherein a first horizontal plane intersects the first fastener, wherein in an assembled configuration, the collar is in a first position, and the second edge, the middle region, and the central point intersect the first horizontal plane, and in a pre-assembled configuration, the collar is in a second position, and the middle region is positioned above the first horizontal plane and the second edge is positioned below the first horizontal plane.

2. The play pen of claim 1, wherein each of the plurality of push rods has a third end opposite a fourth end, wherein the third end is closer to the first axis than the fourth end.

3. The play pen of claim 2, wherein the third end moves away from the central point as the play pen moves from the assembled configuration to the pre-assembled configuration.

4. The play pen of claim 3, wherein the fourth end moves toward the first axis as the play pen moves from the assembled configuration to the pre-assembled configuration.

5. The play pen of claim 4, wherein the clip of the plurality of first straps is configured to be secured or unsecured to each of the plurality of push rods.

6. The play pen of claim 5, wherein each of the fourth ends is connected to each of the plurality of legs by a push sleeve.

7. The play pen of claim 6, wherein each of the push sleeves is configured to be retained on and slide along a first length of one of the plurality of legs.

* * * * *